US007178500B1

(12) United States Patent
Belter et al.

(10) Patent No.: US 7,178,500 B1
(45) Date of Patent: Feb. 20, 2007

(54) MARINE ENGINE WITH A WATER COOLED OIL GALLERY

(75) Inventors: David J. Belter, Oshkosh, WI (US); David W. Heidel, Green Lake, WI (US)

(73) Assignee: Brunswick Corporation, Lake Forest, IL (US)

( * ) Notice: Subject to any disclaimer, the term of this patent is extended or adjusted under 35 U.S.C. 154(b) by 0 days.

(21) Appl. No.: 11/238,370

(22) Filed: Sep. 29, 2005

(51) Int. Cl.
*F01M 5/00* (2006.01)
*F01P 11/08* (2006.01)

(52) U.S. Cl. ..... 123/196 AB; 123/41.33; 123/195 R

(58) Field of Classification Search ..... 123/196 R, 123/196 AB, 41.33, 195 R
See application file for complete search history.

(56) References Cited

U.S. PATENT DOCUMENTS

| | | | | |
|---|---|---|---|---|
| 4,702,204 | A * | 10/1987 | Anno et al. | 123/196 AB |
| 5,690,062 | A * | 11/1997 | Yamada | 123/196 AB |
| 5,967,112 | A * | 10/1999 | Haga et al. | 123/196 AB |
| 6,067,951 | A | 5/2000 | Kitajima | 123/196 R |
| 6,305,999 | B1 | 10/2001 | Toyama et al. | 440/88 |
| 6,358,108 | B2 | 3/2002 | Murata et al. | 440/88 |
| 6,416,372 | B1 | 7/2002 | Nozue | 440/88 |
| 6,619,274 | B2 | 9/2003 | Miyashita et al. | 123/542 |
| 6,834,635 | B2 | 12/2004 | Yomo et al. | 123/196 AB |
| 6,868,819 | B2 | 3/2005 | Saiga et al. | 123/196 W |

FOREIGN PATENT DOCUMENTS

| | | | |
|---|---|---|---|
| EP | 0505346 A1 | * | 3/1992 |
| JP | 62279219 A | * | 12/1987 |
| JP | 01077902 A | * | 3/1989 |
| JP | 08135426 A | * | 5/1996 |

* cited by examiner

*Primary Examiner*—Noah P. Kamen
(74) *Attorney, Agent, or Firm*—William D. Lanyi

(57) ABSTRACT

A lubricant supply system for a marine engine is provided with a lubricant conduit that is formed within an engine block in close proximity to a coolant conduit. The coolant conduit is extended, by a bulge, in a direction toward the lubricant conduit in order to reduce the distance through which heat must travel through the base material of the engine block to cool the lubricant flowing through the lubricant conduit by the water flowing through the coolant conduit.

6 Claims, 3 Drawing Sheets

MARINE ENGINE WITH A WATER COOLED OIL GALLERY

BACKGROUND OF THE INVENTION

1. Field of the Invention

The present invention is generally related to an oil supply system for a marine engine and, more particularly, to a marine engine with a main lubricant conduit, or gallery, which is cooled by its proximity to a water conduit of the engine.

2. Description of the Related Art

Many different techniques have been used to reduce the operating temperature of lubricating oil used in a marine engine. Typically, these cooling techniques relate to the use of cooling water to reduce the temperature of an oil sump.

U.S. Pat. No. 6,619,274, which issued to Miyashita et al. on Sep. 16, 2003, describes an outboard engine intake air cooling system. An air intake cooling system for an outboard motor is equipped with a V-type engine is described. In one embodiment, the air intake cooling system has an air intake manifold and a water-cooling passageway positioned in the air intake manifold for cooling air in the air intake manifold. This system further has a water sleeve for cooling a main oil reservoir located inside the V-type engine, the water sleeve being positioned next to the main oil reservoir and connected to the water cooling passageway.

U.S. Pat. No. 6,868,819, which issued to Saiga et al. on Mar. 22, 2005, describes a lubricating system for an outboard motor. In one embodiment, the lubricating system has an oil pump positioned near the bottom of the engine, the oil pump driven by an oil pump rotor that is positioned at a connection between the crankshaft and an engine driven shaft. The oil pump is linked to the crankshaft. The system further includes a cam shaft driving mechanism for transmitting the rotation of the crankshaft to a propulsion device. The cam shaft driving mechanism is also positioned at the connection between the crankshaft and the driveshaft and is also linked to the crankshaft. The lubrication system also has a main oil tank for storing lubricating oil circulated by the oil pump and an engine cooling water passageway positioned next to the main oil tank. Another element of this embodiment of the lubricating system is a filter mounting base positioned on an outer wall of the cylinder blocks. The system also has oil passageways positioned at the bottom of the cylinder blocks for distributing the oil.

U.S. Pat. No. 6,834,635, which issued to Yomo et al. on Dec. 28, 2004, describes an outboard motor which includes an engine, an engine holder disposed below the engine, a driveshaft housing which is disposed below the engine holder, an intake device including an intake manifold disposed to a side surface of the engine, a lubricant supply device for supplying lubricant oil to the engine, an oil filter disposed below the intake manifold, and an oil cooler arranged below the intake manifold and between the engine and the oil filter. The oil cooler includes a casing and a cooler body disposed inside the casing and the casing is formed with a cooling water flowing-in union and a cooling water flowing-out union disposed in correspondence with the cooling water flowing-in union.

U.S. Pat. No. 6,358,108, which issued to Murata et al. on Mar. 19, 2002, describes an outboard motor which includes a first case and a second case disposed below the first case. The first case houses therein an oil pan and an upper part of a driveshaft. Within the oil pan, engine oil is held. The second case has its upper edge portion coupled to a lower edge portion of the first case. The arrangement prevents the oil pan from being affected by heat of the exhaust gas. Thus it becomes possible to prevent the engine oil held within the oil pan from increasing in temperature.

U.S. Pat. No. 6,067,951, which issued to Kitajima on May 30, 2000, describes an engine for an outboard motor. The cooling and exhaust systems for the engine are formed with a minimum number of components and ceiling joints. The flow of cooling the water to and from the engine is controlled so that the exhaust gas interchange area between the powerhead and the driveshaft housing will be well cooled, as will the oil reservoir for the engine and the oil returned to it.

U.S. Pat. No. 6,305,999, which issued to Toyama et al. on Oct. 23, 2001, describes an outboard motor that includes an engine holder, an engine which is disposed above the engine holder in a state of the outboard motor mounted to a hull in which a crankshaft extends substantially perpendicularly, and an oil pan disposed below the engine holder. A cooling water passage is formed in the oil pan and a driveshaft housing to guide the cooling water pumped up by the water pump to the engine. A relief valve is disposed on the way of the cooling water passage so as to discharge the cooling water into the exhaust chamber.

U.S. Pat. No. 6,416,372, which issued to Nozue on Jul. 9, 2002, describes an outboard motor cooling system. It includes an improved construction for enhancing cooling of the lubrication system. An oil pan depends from an engine of the outboard motor and into a driveshaft housing. A periphery coolant jacket is provided around the oil pan. A water pool is defined between the oil pan and the driveshaft housing. An exhaust manifold passes through in a hollow of the oil pan and a water curtain is defined between the hollow wall and the exhaust manifold. An upstanding water passage is also disposed through the oil pan. The oil pan therefore is sufficiently cooled.

The patents described above are hereby expressly incorporated by reference in the description of the present invention.

It would be beneficial if a system could be provided that provides additional cooling to the lubricating oil of an outboard motor engine by other than the traditional methods which utilize oil coolers or cooling systems which cool the oil while it is within the oil sump of the outboard motor.

SUMMARY OF THE INVENTION

A marine engine, made in accordance with a preferred embodiment of the present invention, comprises a lubricant conduit and a coolant conduit. The lubricant conduit is formed within the engine and configured to conduct a flow of lubricant between an oil sump and at least one lubricated surface of the engine. Typically, the lubricant conduit conducts lubricating oil from the oil sump to the bearings which support a crankshaft of the engine. The lubricant conduit has an internal dimension extending from a first point on an internal surface of the lubricant conduit to a second point on an opposite internal surface of the lubricant conduit. The coolant conduit is formed within the engine and configured to conduct a flow of coolant through the engine and in thermal communication with heat producing portions of the engine. The lubricant conduit is spaced apart from the coolant conduit by a distance which is less than the magnitude of the internal dimension of the coolant conduit. In a particularly preferred embodiment of the present invention, the lubricant conduit is spaced apart from the coolant conduit by a distance which is less than the magnitude of the internal dimension.

A preferred embodiment of the present invention can further comprise an internal bulge formed in the coolant conduit at a region of the engine which the bulge reduces the distance by which the lubricant and coolant conduits are spaced apart. The bulge extends, in a direction generally parallel to a central axis of the lubricant conduit, a distance which is at least five times the magnitude of the internal dimension of the lubricant conduit. In a particularly preferred embodiment of the present invention, the bulge extends a distance which is at least ten times the magnitude of the internal dimension of the lubricant conduit.

In a preferred embodiment of the present invention, it further comprises a lubricant sump and a lubricant pump. The lubricant pump is connected in fluid communication between the lubricant conduit and the lubricant sump to cause the lubricant to flow from the lubricant sump into and through the lubricant conduit.

In a particularly preferred embodiment of the present invention, the coolant is water and the lubricant conduit has a generally circular cross section. In an alternative embodiment of the present invention, the lubricant conduit can have a cross section defined by a major axis and a minor axis. In such an embodiment, the internal dimension of the lubricant conduit is the major axis in a preferred embodiment.

BRIEF DESCRIPTION OF THE DRAWINGS

The present invention will be more fully and completely understood from a reading of the description of the preferred embodiment in conjunction with the drawings, in which.

DESCRIPTION OF THE PREFERRED EMBODIMENT

Figure 1:
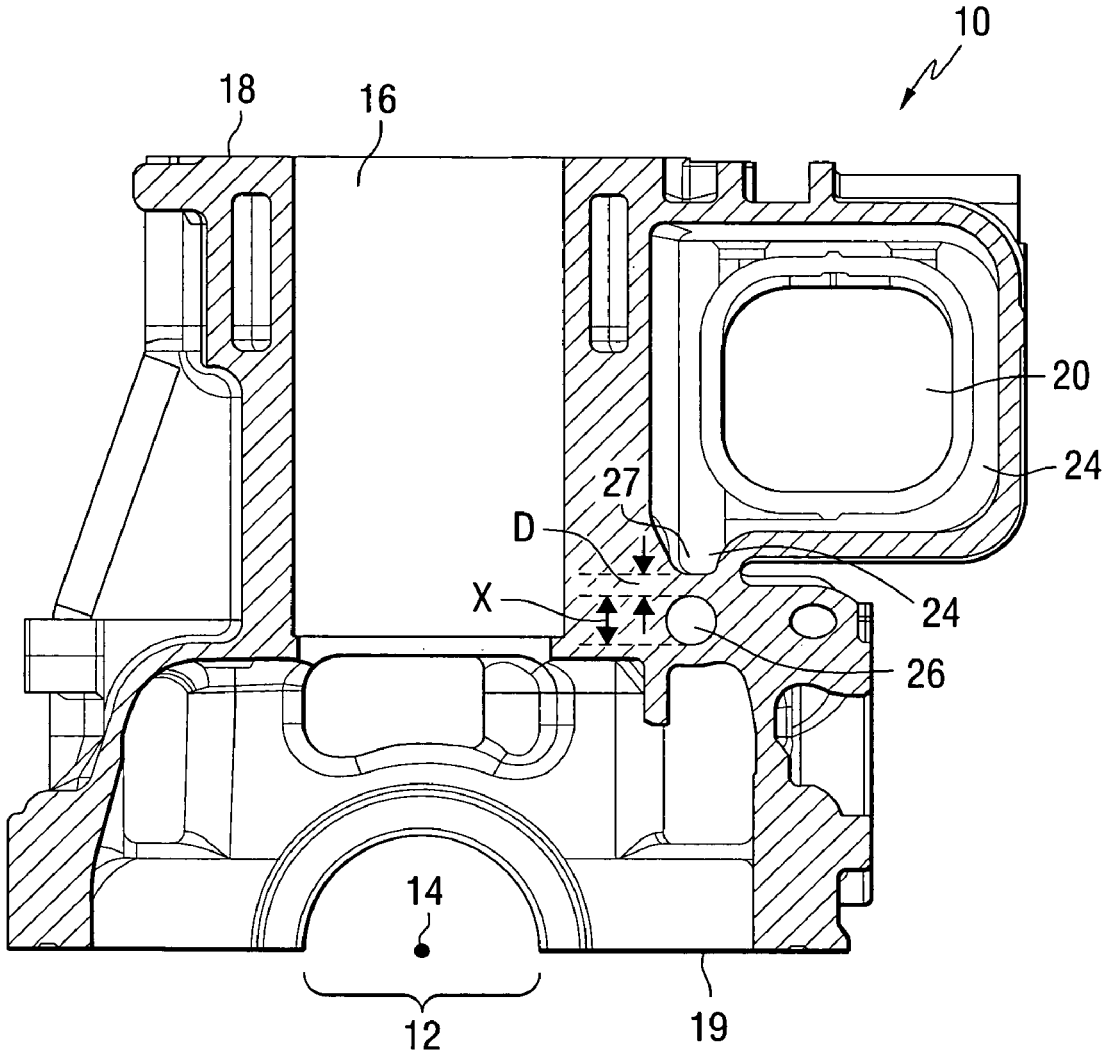
FIG. 1 is a sectional view of a marine engine.

Throughout the description of the preferred embodiment of the present invention, like components will be identified by like reference numerals.

FIG. 1 shows a section view taken through an engine block 10 of a marine engine. For purposes of reference, the opening identified by reference numeral 12 is the location where a crankshaft is supported for rotation, by a plurality of bearings, about an axis 14. Reference numeral 16 identifies a cylinder opening of the engine. A cylinder head, which is not shown in FIG. 1, is attachable to surface 18. In addition, a crank case cover, or bed plate, is attachable to surface 19. Reference numeral 20 identifies an exhaust passage which extends in a generally vertical direction along one side of the engine 10. A coolant jacket 24 surrounds the exhaust passage 20 in order to remove heat from the exhaust conduit. A main oil gallery 26 extends in a generally vertical direction through the body of the engine 10 to conduct a flow of liquid lubricant to various lubricated surfaces, such as bearings, within the structure of the engine 10.

The water jacket 24 is extended, as shown in FIG. 1, to provide a bulge 27. The bulge 27 extends from the water jacket 24 in a direction toward the main oil gallery 26. As will be described in greater detail below, the lubricant conduit, or oil gallery 26, is spaced apart from the coolant conduit, or water jacket 24, by a distance D which is less than the magnitude of an internal dimension X of the lubricant conduit 26.

With continued reference to FIG. 1, the lubricant conduit 26, or main oil gallery, is shown as being generally circular in cross section. As a result, internal dimension X is the diameter of that cross section. However, it should be clearly understood that the cross section of the lubricant conduit 26 need not be circular.

The bulge 27 is provided to decrease the magnitude of the distance D in order to improve the heat transfer characteristics of the arrangement. With a reduced magnitude of the distance D, heat from the oil flowing through the lubricant conduit 26 can be absorbed more effectively by coolant flowing through the coolant conduit 24.

Figure 2:
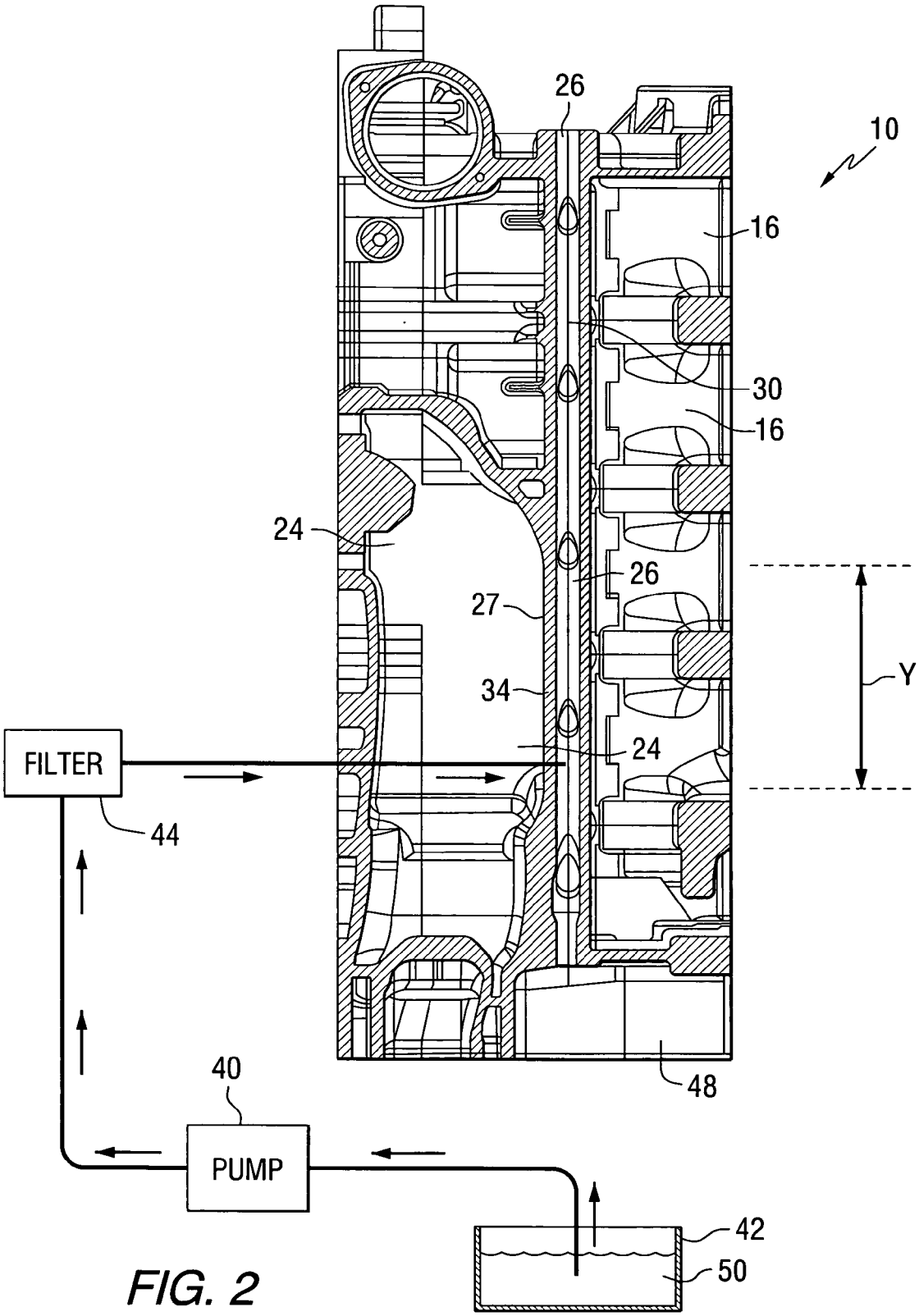
FIG. 2 is a side sectional view of the marine engine.

FIG. 2 shows a side view of the engine 10. The lubricant conduit 26 is shown extending vertically through the body of the engine block. The coolant conduit 24 is shown with its bulge 27 extending from the coolant conduit 24 in a direction toward the lubricant conduit 26. For purposes of reference, the bulge 27 is illustrated in FIG. 2 as extending for a distance Y in a direction that is generally parallel to a central axis 30 of the lubricant conduit 26. The wall 34 between the lubricant conduit 26, or main oil gallery, and the coolant conduit 24, or water jacket, is thinner in the region of the bulge 27 for the distance identified by reference letter Y in FIG. 2. In this region, heat transfer between the oil flowing through the lubricant conduit 26 and the water flowing through the coolant conduit 24 is significantly improved.

With continued reference to FIG. 2, a lubricant pump 40, a lubricant sump 42, and a lubricant filter 44 are shown schematically in relation to the engine 10. These components are illustrated schematically in FIG. 2 because the section view of the engine 10 in FIG. 2 would not otherwise show them. It should be understood that the lubricant pump 40 would normally be located within the cavity identified by reference numeral 48. The lubricant pump 40 draws liquid lubricant 50 from the lubricant sump 42 and causes the liquid lubricant to flow through the filter 44 and into a location within the lubricant conduit 26 as shown in FIG. 2. The lubricant 50, such as lubricating oil, then flows through the lubricant conduit 26 to various regions of the engine where lubricated surfaces exist, such as the bearings associated with the crankshaft in region 12, as described above in conjunction with FIG. 1.

Figure 3:
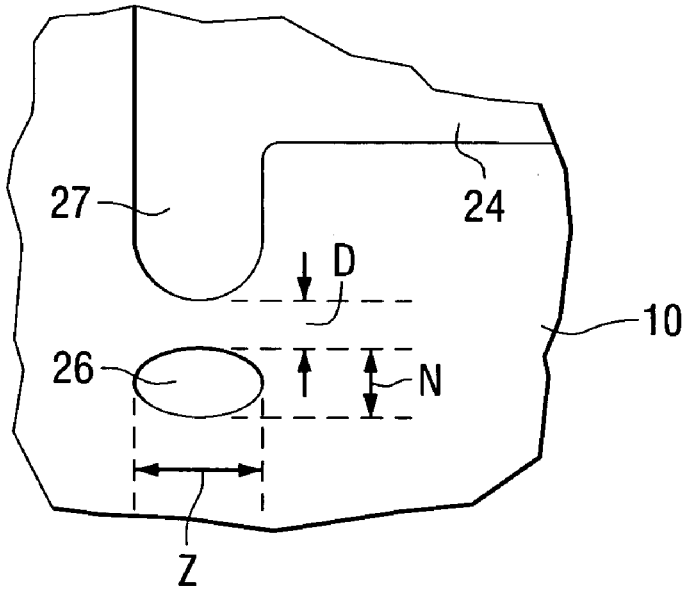
FIG. 3 is an enlarged view of a region of the marine engine where a coolant conduit is most proximate to a lubricant.

FIG. 3 is an enlarged view of the region of an engine 10 where the lubricant conduit 26 and the coolant conduit 24 are nearest to each other. The distance between the bulge 27 and the lubricant conduit 26 is identified by reference letter D in FIG. 3. It should be noted that the lubricant conduit 26, or main oil gallery, is illustrated as having an oval cross section in FIG. 3. This is different than the generally circular cross section shown in FIG. 1. The cross sectional shape of the lubricant conduit 26 is not limiting to the present invention.

With continued reference to FIG. 3, the oval shape of the lubricant conduit 26 is shown having a major axis Z and a minor axis N. When reference is made to the relative magnitudes of the internal dimension of the lubricant conduit 26 and the distance D between the lubricant conduit 26 and the coolant conduit 24, that internal dimension is the major axis Z.

Figure 4:
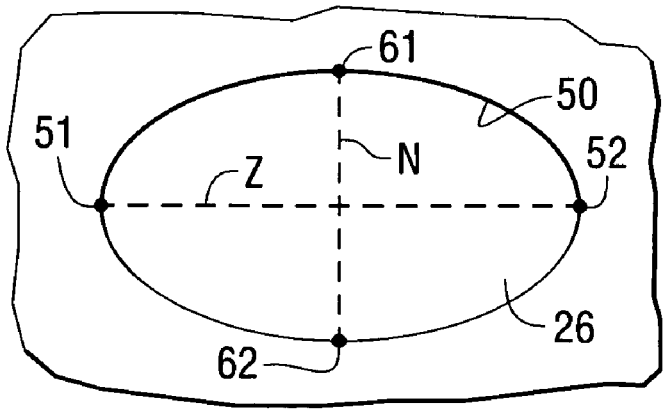
FIG. 4 is a geometric representation of a hypothetical cross section of a lubricant conduit.

FIG. 4 is a schematic representation of an oval shape that is used herein for purposes of discussing the various dimensions used to describe the present invention. As described above, the lubricant conduit 26 is used to direct a flow of liquid lubricant through the structure of an engine block.

Reference numeral 50 in FIG. 4 identifies an internal surface of the lubricant conduit 26. With reference to the major axis Z, it extends from a first point 51 on the internal surface 50 to a second point 52 on an opposite internal surface of the lubricant conduit 26. The internal dimension Z is described in terms of these first and second points, 51 and 52, on opposite portions of the internal surface 50. This is intended to convey the concept that the internal dimension Z can represent the maximum distance represented by the various dimensions of the cross sectional shape. Alternately, the internal dimension can be the dimension identified by reference letter N in FIG. 4. This extends between a first point 61 and a second 62. It should be understood that the lubricant conduit 26, in alternate embodiments of the present invention, can be virtually any shape. These include circular cross sections, oval-shaped cross sections, rectangular cross sections, or any other shape that is suitable to convey liquid lubricant through the body of an engine block and distribute that liquid lubricant to various lubricated surfaces.

With continued reference to FIGS. 1–4, it should be noted that the lubricant conduit 26 is a cavity formed through the body or structure of the engine block itself. It is not a conduit that is attached to or added to the engine 10. Instead, it is formed directly through the structure of the engine block. In a typical application of the present invention, the lubricant conduit 26 is formed during the casting process that forms the engine block. This casting process, in a typical application of the present invention, is a lost foam casting process. However, it should be understood that the internal cavity of the lubricant conduit 26 can be formed through the structure of the engine block in alternate ways. The manufacturing technique used to produce the lubricant conduit 26 within the structure of the engine block is not limiting to the present invention.

With continued reference to FIGS. 1–4, it can be seen that a preferred embodiment of the present invention provides a marine engine that comprises a lubricant conduit 26 that is formed within the engine 10 and configured to conduct a flow of lubricant 50 through the engine 10. The lubricant conduit 26 has an internal dimension, such as major axis Z, which extends between two points on the internal surface 50 of the lubricant conduit. In a particularly preferred embodiment of the present invention, the internal dimension is the maximum dimension extending across the lubricant conduit. A coolant conduit 24 is formed within the engine 10 and configured to conduct a flow of coolant through the engine and in thermal communication with heat producing portions such as cylinders 16, of the engine 10. The lubricant conduit 26 is spaced apart from the coolant conduit 24 by a distance D which is less than the magnitude of the internal dimension X, as illustrated in FIG. 1.

The lubricant conduit 26 can be spaced apart from the coolant conduit 24 by a distance D which is less than the magnitude of the internal dimension X in certain embodiments in which particularly improved heat transfer is required between the water flowing through the coolant conduit 24 and the oil flowing through the lubricant conduit 26. An internal bulge 27 is formed in the coolant conduit 24 at a region of the engine 10 at which the bulge reduces the distance D by which the lubricant and coolant conduits, 26 and 24, are spaced apart. The bulge 27 extends, in a direction generally parallel to a central axis 30 of the lubricant conduit 26, a distance Y which is at least five times the magnitude of the internal dimension X of the lubricant conduit 26 in a preferred embodiment of the present invention. In a particularly preferred embodiment, in which significant heat transfer improvement is required, the distance Y can be at least ten times the magnitude of the internal dimension X. In a particularly preferred embodiment of the present invention, it further comprises a lubricant sump 42 and a lubricant pump 40. The lubricant pump 40 is connected in fluid communication between the lubricant conduit 26 and the lubricant sump 42 to cause the lubricant 50 to flow from the lubricant sump 42 into and through the lubricant conduit 26. In a typical application of the present invention, the coolant flowing through the coolant conduit 24 is water. The lubricant conduit 26 typically has a generally circular cross section. However, the lubricant conduit 26 can have a cross section defined by a major axis Z and a minor axis N. The internal dimension, identified by reference letter X in FIG. 1, can be the major axis Z.

Although the present invention has been described in particular detail and illustrated to show a preferred embodiment, it should be understood that alternative embodiments are also within its scope.

We claim:

1. A marine engine, comprising:

a lubricating oil conduit formed within said engine and configured to conduct a flow of lubricating oil through a portion of a block of said engine, said lubricating oil conduit having an internal dimension extending from a first point on an internal surface of said lubricating oil conduit to a second point on an opposite internal surface of said lubricating oil conduit;

a coolant conduit formed within said engine and configured to conduct a flow of coolant through said engine and in thermal communication with heat producing portions of said engine, said lubricating oil conduit being spaced apart from said coolant conduit by a distance which is less than the magnitude of said internal dimension; and an internal bulge formed in said coolant conduit at a region of said engine at which said bulge reduces said distance by which said lubricating oil and coolant conduits are spaced apart, said bulge extending, in a direction generally parallel to a central axis of said lubricating oil conduit, a distance which is at least twice the magnitude of said internal dimension, said lubricating oil conduit having a cross section defined by a major axis and a minor axis.

2. The engine of claim 1, wherein:

said bulge extends, in a direction generally parallel to a central axis of said lubricating oil conduit, a distance which is at least ten times the magnitude of said internal dimension.

3. The engine of claim 1, further comprising:

a lubricating oil sump; and a lubricating oil pump, said lubricating oil pump being connected in fluid communication between said lubricating oil conduit and said lubricating oil sump to cause said lubricating oil to flow from said lubricating oil sump into and through said lubricating oil conduit.

4. The engine of claim 3, wherein:

said coolant is water.

5. The engine of claim 3, wherein:

said lubricating oil conduit has a generally circular cross section.

6. The engine of claim 1, wherein:

said internal dimension is said major axis.

* * * * *